United States Patent [19]

Shimizu

[11] 3,978,314

[45] Aug. 31, 1976

[54] ELECTRIC HAIR DRIER WITH AIR BLOWING CONDITION INDICATOR

[76] Inventor: Nobuzo Shimizu, No. 5-3, Hon, Higashiosaka, Osaka, Japan

[22] Filed: Nov. 7, 1974

[21] Appl. No.: 521,689

[52] U.S. Cl. ..... 219/361; 34/97; 200/317; 219/364; 219/370; 219/379; 219/473; 219/506

[51] Int. Cl.[2] ..... H05B 1/02; F24H 3/04; F24H 1/04

[58] Field of Search ..... 219/364, 369, 370, 379, 219/380, 506, 472, 473; 200/314, 317, 373; 34/96–101, 243

[56] References Cited

UNITED STATES PATENTS

| | | | |
|---|---|---|---|
| 1,318,152 | 10/1919 | Hughs et al. | 219/380 UX |
| 1,809,458 | 6/1931 | Wahl | 219/364 |
| 2,240,340 | 4/1941 | Mills et al. | 219/506 X |
| 2,403,824 | 7/1946 | Newell | 219/506 X |
| 2,437,555 | 3/1948 | Rees | 200/314 |
| 2,697,164 | 12/1954 | Knapp et al. | 219/364 |
| 2,721,254 | 10/1955 | Burgess | 219/370 X |
| 2,735,924 | 2/1956 | Shaw | 219/506 X |

FOREIGN PATENTS OR APPLICATIONS

| | | | |
|---|---|---|---|
| 100,299 | 2/1937 | Australia | 219/473 |
| 214,544 | 10/1961 | Austria | 219/473 |

*Primary Examiner*—A. Bartis
*Attorney, Agent, or Firm*—George B. Oujevolk

[57] ABSTRACT

A hand held hair drier includes a cylindrical heater sleeve longitudinally coupled to a main body provided with a handle extending normally therefrom. The handle includes first and second windows of different, readily distinguishable colors positioned at a location above the normal gripping portion thereof. A pair of switches arranged to be operated by a two position push button located in the handle and arranged to selectively energize an electric heater in the heater sleeve and/or an electric motor driven fan in the main body through first and second circuit each provided with a signal lamp arranged adjacent a respective one of the different colored windows. When the push button is activated to the first position one switch is closed and the fan is energized to blow unheated air and one of the lamps is lit to illuminate a window. When the push button is activated to the second position both the heater and fan are energized so that heated air is delivered and both lamps are lit to illuminate both windows.

1 Claim, 3 Drawing Figures

ELECTRIC HAIR DRIER WITH AIR BLOWING CONDITION INDICATOR

BACKGROUND OF THE INVENTION

The present invention relates to a handy hair drier for feeding warm air or room temperature air having a colored lamp indicator, the indicator functioning for distinguishing the air blowing condition by sight so as to prevent an accidental burn that results from the careless use of the hair drier.

BRIEF DESCRIPTION OF THE PRIOR ART

Conventional hair driers of this kind generally have the an indicating device for the above effect, of course but are defective in common that the indicator cannot be seen unless the eyes are very close to the indicator with the result that most users confirm the blowing air condition by means of feeling by hand.

OBJECT OF THE INVENTION

A first object of this invention is to provide a handy hair drier provided with an electrical indicator at the outer peripheral surface thereof so as to be readily visible thereby making it possible to determine on sight the state of the air blowing and whether it is warm or not.

This object can be accomplished by the improvement, combination and operation of the parts constituting this invention, the preferred embodiment of which will be apparent from the annexed drawing in which.

Figure 1:
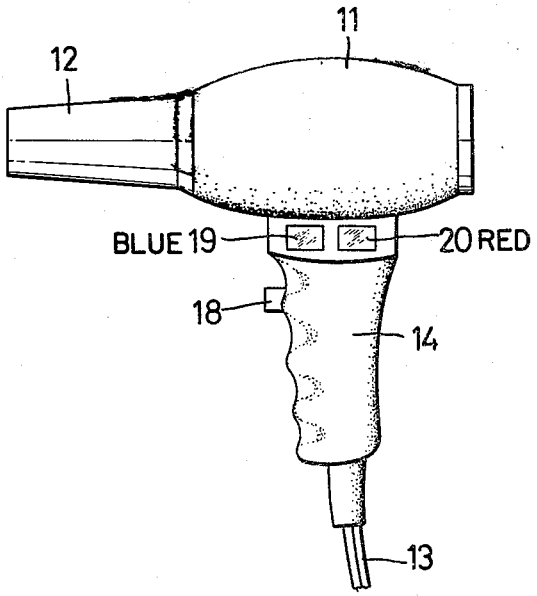
FIG. 1 is a side view of a hair drier in this invention.

In FIG. 1, numeral 11 designates the main body of a hair drier mounted with a heater-sleeve 12 at the front thereof and a grip 14 therebeneath, said grip 14 connecting with a plug in cord as seen in said figure.

Figure 2:
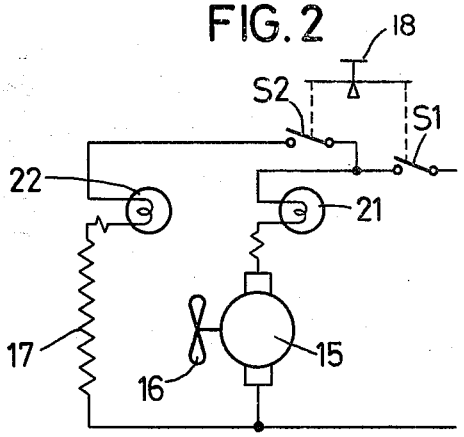
FIG. 2 shows electrical circuits of the above.

The main body 11 has a motor 15 and a fan 16 driven by said motor 15 as shown in FIG. 2, the heater-sleeve 12 containing a heater 17 and the grip 14 has at the surface thereof a push-button 18 acting on switches S1 and S2 for switching on and off the circuits of the motor 15 and the heater 17, respectively.

The grip 14 is further provided at its upper portion with an indicator 19 indicative of room air and another indicator 20 for hot air, both indicators 19 and 20 at their outer surfaces being composed of ornamental glass, synthetic resin and the like. Within the room air indicator 19 there is a lamp 21 connected in series to the circuit of motor 15 via a resistor and within the hot air indicator 20 there is a lamp 22 connected in series to the circuit of heater 17 also via a resistor.

Both lamps 21 and 22 are colored so as to be able to differentiate between the two such as red for hot air and blue for room air in this embodiment and also the second embodiment.

Figure 3:
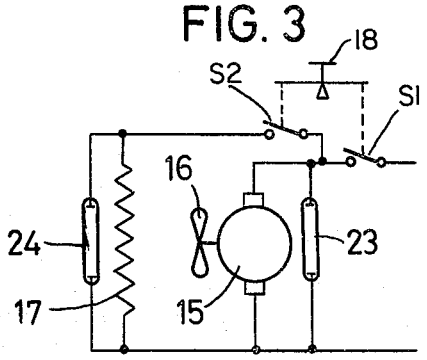
FIG. 3 shows electrical circuits of this invention in a second embodiment.

In the second embodiment shown in FIG. 3, neon lamps 23 and 24 are used instead of lamps 21 and 22, both being arranged in parallel to the circuits of the heater 17 and the motor 15.

In the foregoing embodiments, both indicators are disposed on the grip 14 at the upper side portion. The position of the indicators needs not be limited to the location shown but consideration is given to a position easiest to see as a matter of course.

In the plugged in state of the hair drier, lamp 21 or neon lamp 23 shows a blue light indicative of unheated air blowing when said switch S1 in the circuit of motor 15 is closed upon pushing of said push-button 18, and upon additional pushing of push-button 18 both switches S1 and S2 are closed, both lamps 21 and 22 or neon lamps 23 and 24 i.e., the blue and red light are lit together thereby indicating that the warm air is on.

What is claimed is:

1. A hair dryer comprising in combination a. a hollow cylindrical main body;

b. a cylindrical heater sleeve longitudinally coupled to said main body;

c. an extended grip handle normal to said main body and said sleeve with a plug-in cord at the distal end of said grip handle, a two position switching push-button on said grip handle and first and second windows on said grip handle above the gripping portion thereof so as to be visible when the handle is gripped in the hand; said windows being of different, readily distinguishable colors; and, d. a circuit in said grip handle and said main body including first and second leads connected to said cord, a frist circuit for feeding room air to said heater sleeve between said first and second leads consisting of a first switch responsive to said push-button first position, a first lamp coupled to said first switch set to light upon closing of said first switch, a motor in said main body, and fan in said main body driven by said motor, said motor being in series with said first switch in said first circuit, a second circuit in series with said first switch and in parallel with said first lamp and said motor, said second circuit consisting of a second switch responsive to said push-button second position, a second lamp coupled to said second switch and a heater in said heater sleeve in series with said second switch in said second circuit, whereby, when said push-button is pressed to a first position, said first switch is closed to energize said motor to cause said fan to blow room air out of said sleeve, and said first lamp is lit, said one light appearing in said one window, but when said push-button is further pushed to a second position, said heater is energized to heat the blown air and said second lamp is also lit so that a light appears in each of the different colored windows.

* * * * *